United States Patent [19]

Spivey

[11] Patent Number: 4,589,565

[45] Date of Patent: May 20, 1986

[54] PORTABLE LIQUID STORAGE TANK

[76] Inventor: Bruce T. Spivey, 320 Encino Dr., Oakview, Calif. 93022

[21] Appl. No.: 709,100

[22] Filed: Mar. 7, 1985

Related U.S. Application Data

[63] Continuation of Ser. No. 567,732, Jan. 3, 1984, abandoned.

[51] Int. Cl.[4] ..... B65D 87/00

[52] U.S. Cl. ..... 220/71; 220/1 B; 220/1.5; 220/5 A

[58] Field of Search ..... 220/1 B, 1 V, 1.5, 5 A, 220/71, 72

[56] References Cited

U.S. PATENT DOCUMENTS

| | | | |
|---|---|---|---|
| 2,331,483 | 10/1943 | Lawman et al. | 220/1 B |
| 2,675,940 | 4/1954 | Schmitz | 220/71 |
| 2,975,927 | 3/1961 | Arne | 220/1 B |
| 3,081,104 | 3/1963 | Schmiermann | 220/1 V X |
| 3,456,830 | 7/1969 | Golder | 220/1.5 |
| 3,612,568 | 10/1971 | Stensrud | 220/1.5 X |
| 3,907,148 | 9/1975 | Meller et al. | 220/1.5 |

*Primary Examiner*—Steven M. Pollard
*Attorney, Agent, or Firm*—Kenneth J. Hovet

[57] ABSTRACT

A self-supporting transportable storage vessel having a capacity in the range of 100 to 700 barrels. The flat vessel sidewalls are at least five feet high and corrugated with a corrugation width to depth ratio of less than 7:1. A vessel floor is provided having an underlying peripheral frame with cross members and foundation stringers. The vessel may be transported by attachment to truck and wheel assemblies.

20 Claims, 9 Drawing Figures

PORTABLE LIQUID STORAGE TANK

This is a continuation of application Ser. No. 567,732, filed Jan. 3, 1984, now abandoned.

BACKGROUND OF THE INVENTION

1. Field of the Invention

The present invention relates to storage vessels and, more particularly, to transportable liquid storage tanks having corrugated sidewalls.

2. Description of the Prior Art

U.S. Pat. No. 3,131,949 describes a self-sustaining tank for transporting liquids, primarily to and from oil and gas depots. Such tanks contain relatively small volumes and are permanently mounted on wheels. They are not adapted for storage purposes and, because of their smaller size, sidewall strength is not a major problem.

Vessels used for storage of heavy liquids in relatively large volumes are commonly mounted on foundations. They typically involve permanent reinforced structures having large side beams, peripheral tie rods and the like. Size and weight are not overriding design considerations.

Unfortunately, the above vessels do not satisfy the need for temporary on-site storage means. Relatively large volume vessels are needed for use at oil well drilling sites, construction sites, fire fighting locations and in-situ chemical processing operations. Here, the vessel must be capable of being transported to the site while being large and strong enough to effectively contain the desired liquids.

For those vessels having a capacity in the range of 100 to 700 barrels, sidewall strength and the manner of achieving it become a major consideration. This is especially true when the liquids being contained are heavy—such as oil well drilling fluids having a density on the order of 140 pounds per cubic foot. Existing noncylindrical portable tanks capable of holding such fluids require much internal reinforcement to be self-sustaining. Typically, such tank interiors have multiple beams and tie rods extending vertically and horizontally between floor, roof and opposing sidewalls. In effect, an internal maze is created making cleaning and maintenance an almost impossible task.

When cleaning is difficult, corrosion will become a problem. As corrosion weakens the internal reinforcements, the tank becomes unsafe and not suitable for its intended purpose.

SUMMARY OF THE INVENTION

A unique storage vessel construction is provided that allows for an unobstructed open interior while maintaining sufficient sidewall strength for containing heavy liquids. For quadrilateral sidewalls greater than five feet in height, corrugations are used having a corrugation spacing to depth ratio of about less than 7:1.

The base of the vessel is generally flat and includes reinforcing means that provide a self-supporting foundation and a suitable ground support for the vessel. The top wall may be flat or corrugated and may utilize a connector member for use in securing it to the corrugated sidewalls.

DESCRIPTION OF A PREFERRED EMBODIMENT

Figure 1:
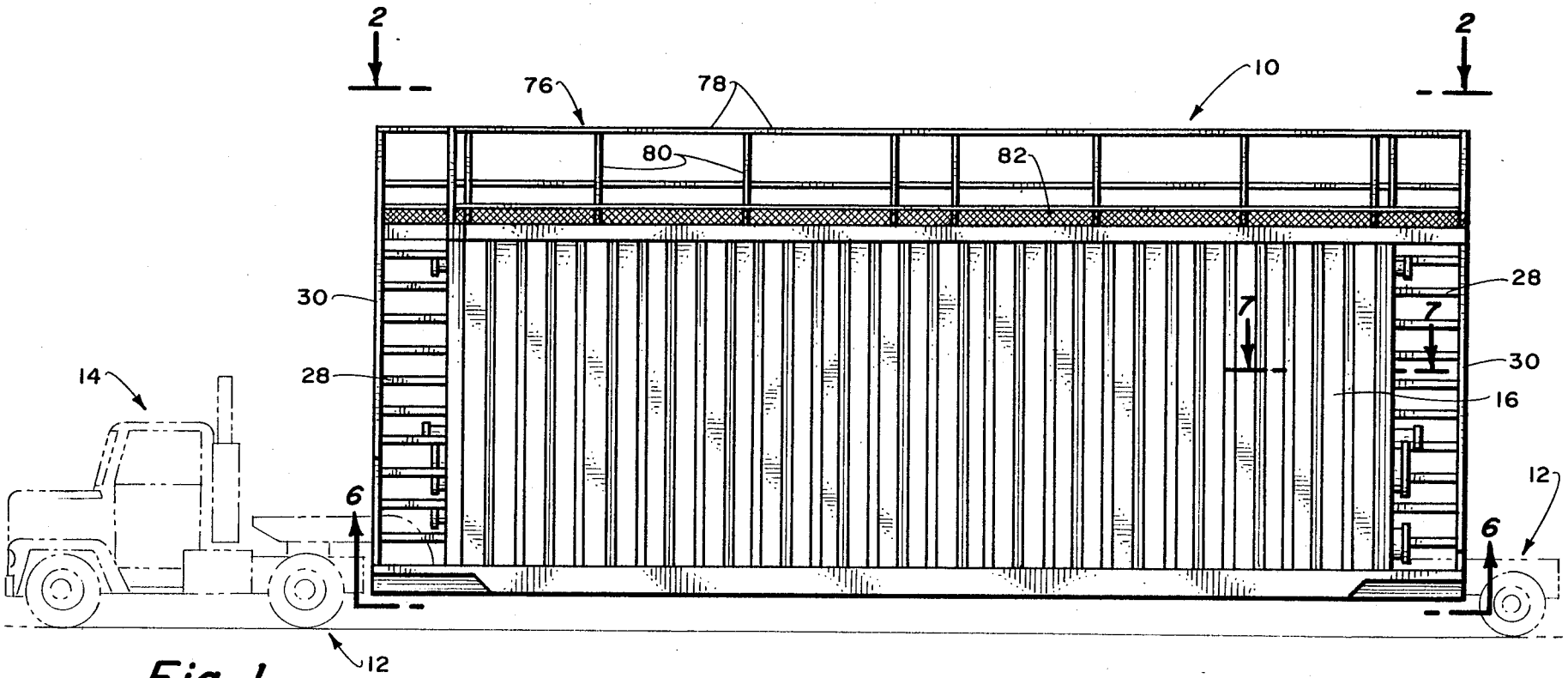
FIG. 1 is a side elevation view of the storage vessel of the invention mounted upon a truck and wheel assembly for transport to a work site.
Figure 3:
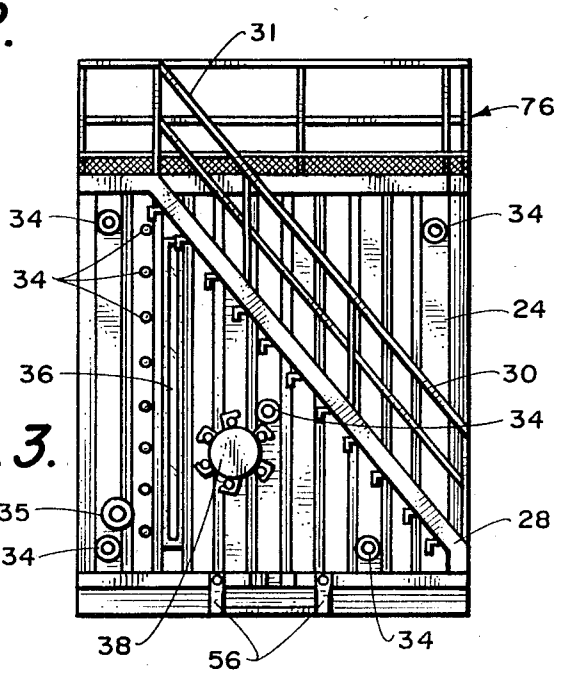
FIG. 3 is a left end elevation view of the vessel of FIG. 1.
Figure 8:
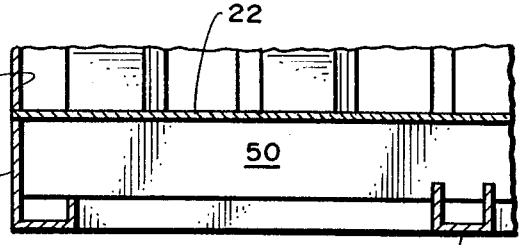
FIG. 8 is an enlarged fragmentary cross-section view taken along line 8 of FIG. 4.

Referring now to the drawings, FIG. 1 shows the overall storage vessel (10) of the present invention mounted upon fore and aft wheel assemblies (12) for transport by truck (14). The vessel comprises at least two sidewalls (16), (18), a top wall (20) and base (22). At least one, and preferably two, end walls (24), (26) are used to complete the vessel and form an enclosed sealable tank capable of containing liquids, flowable particulate materials and/or gases under moderate pressures commonly encountered in storage vessels. End wall (26) is a mirror image of end wall (24), which is shown in FIG. 3.

Each end wall includes ascending means which may comprise steps, a ladder or the stairs shown by reference numeral (28). The stairs as shown are provided with hand railing (30) and extend from above extended base portion (32) and rise diagonally across the face of the end wall to the top of the vessel allowing access to top wall (20).

The end walls further include pipe connections (34), vertical window means (36) and covered manhole means (38). Similarly, top wall (20) is provided with hatch means (40) and pipe connections (42). The number, size and location of the above means and connections are matters of choice as dictated by tank filling, cleaning and maintenance needs.

It will be understood that the present invention is concerned with noncylindrical storage vessels that are absent internal bracing and have sidewalls generally about five to fourteen feet in height. For vessels less than five feet in height, lateral forces are less of a factor and a designer may simply use wall thicknesses that are appropriate to contain the materials contemplated for storage. For taller vessels, extra reinforcements would be required.

Typical applications for the vessel of the present invention involve storage of oil drilling liquids having densities up to about 140 pounds per cubic foot. To store such liquids in vessels sized to contain 100 to 700 barrels of volume, a unique corrugation design was created. For quadrilateral sidewalls about five feet high with about one quarter inch thick steel plate, the corrugation width (W) to corrugation depth (D) ratio should be about 7:1 or less. As the wall height goes up, the ratio goes down. At about 10 feet or height, the ratio should be about 2:1. Between 11 and 12 feet, a ratio of 1:1 may be suitable. In all but the narrowest vessels, the end wall(s) should also be corrugated in the same manner as the sidewalls.

It will be appreciated that for steel plates of less or greater than one quarter inch thickness, the corrugation spacing to depth ratio would be correspondingly less or greater, respectively. For example, with 3/16" thick steel plate and a wall height of six feet, the ratio should be about less than 4:1. For 5/16" thick steel plate and a height of six feet, the ratio should be about 8:1.

Figure 7:
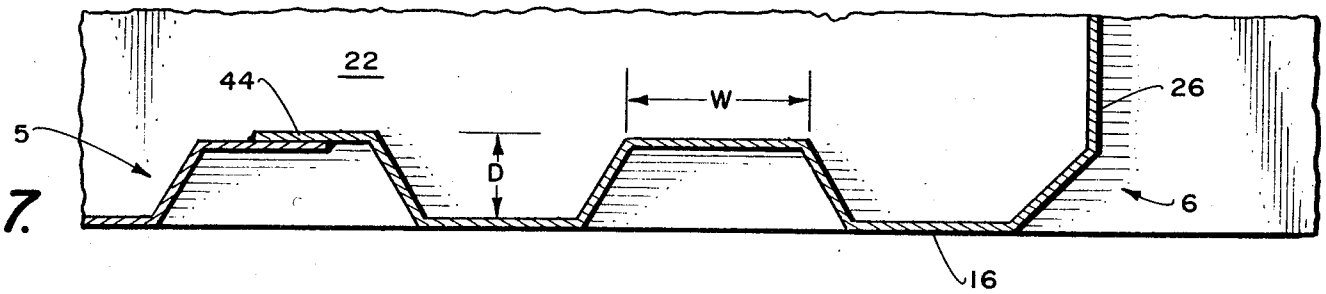
FIG. 7 is an enlarged fragmentary cross-section view taken along lines 7—7 of FIG. 1.
Figure 2:
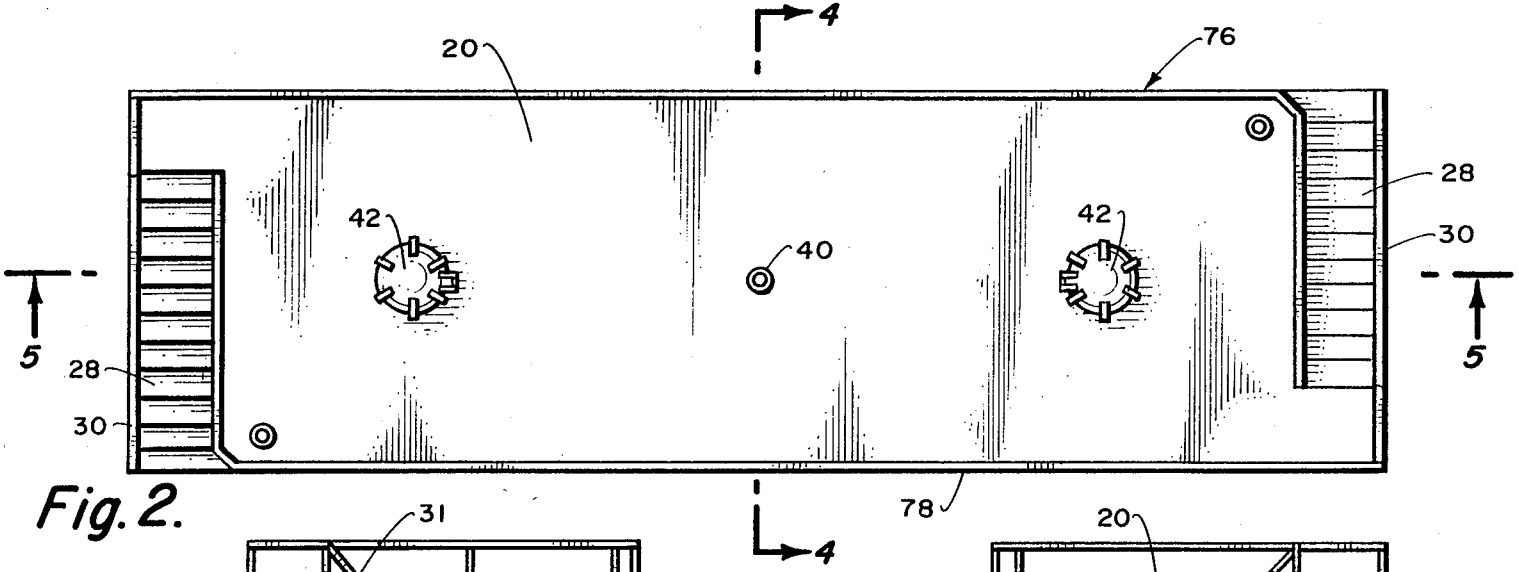
FIG. 2 is a top plan view of the vessel taken along lines 2—2 of FIG. 1.
Figure 4:
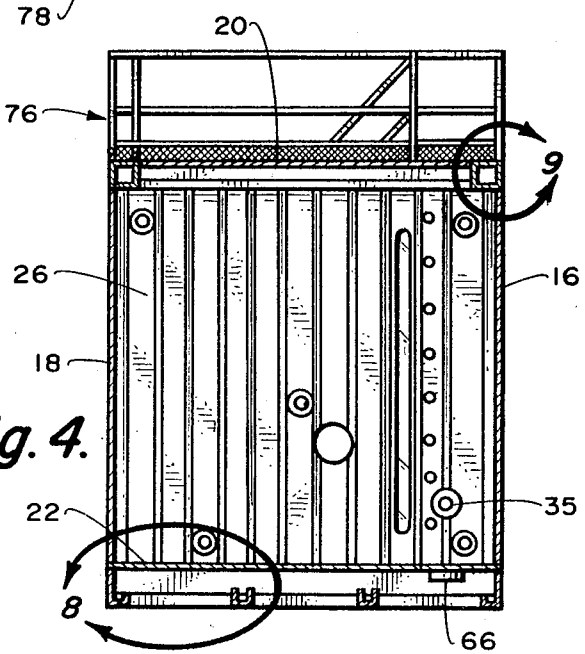
FIG. 4 is a cross-section view taken along lines 4—4 of FIG. 2.

In constructing the vessel of the present invention, the corrugated sidewalls may be factory performed as side and corner panels. FIG. 7 shows corner panel "C" joined with side panel "S" by welded lap joint (44). It is expected that other types of joints such as butt welds with a reinforcing strip or the like would work equally as well for purposes of the present invention.

Base (22) comprises a generally flat plate to which is butt welded the aforementioned side and end walls. The plate is provided with reinforcing means to support the overall structure and allow it to be self-sustaining for transport to work sites. Such means must also provide a strong foundation for the vessel when it is placed on various types of local terrain.

The reinforcing means comprises a frame (46) extending about a major portion of the base periphery. In the embodiment shown, the frame underlies plate (22) and is L-shaped in cross-section along the longitudinal sides of the vessel. Where it extends across the end portions of the base as shown by reference numeral (48), it comprises two U-shaped channels welded together.

Extending parallel to the end portions and connecting the longitudinal portions of frame (46) are cross members (50). The cross members may be welded to the bottom of base (22) and are spaced-apart an equal distance for the even support thereof. As shown, the cross members are flat plates but may be other shapes such as angle, L- or H-shaped beams.

Extending longitudinally of the vessel are foundation members (52). The foundation members are connected to each of the plates (50) and are spaced from base (22) a distance equal to, and coextensive with, the bottom of frame (46). In this manner, the foundation members not only serve to reinforce and tie together the cross members, but function to provide an overall underlying level foundation for the vessel. As shown, the foundation members are U-shaped channels in cross-section, but could be H beams or the like. The open ends of the channels are notched and welded to each cross plate (50).

As mentioned hereinabove, base (22) includes opposing end portions (32) that extend beyond end frame (48). Such extended portions provide attachment means for connection to transport means such as truck-trailer assemblies or the like. The attachment means includes spaced-apart underlying pipes (54) contained within box beams (56) which are welded to the underside of the base portions (32). The base portions are bifurcated by a V-shaped opening (58) and the periphery thereof is provided with underlying trim beams (58). Secured to the bottom of the spaced-apart box beams is a flat plate (62).

Included at each base extension (32) and adjacent to the interior of each end wall are closable drain outlets (64) and sumps (66). It is expected that sumps (66) will operate with a down pipe (not shown) connected to pipe flange connection (35) for evacuating the liquid contents of the vessel in a manner known in the art.

Figure 9:
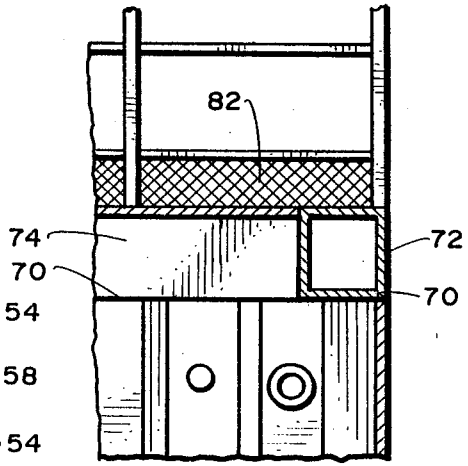
FIG. 9 is an enlarged fragmentary cross-section view taken along line 9 of FIG. 4.
Figure 5:
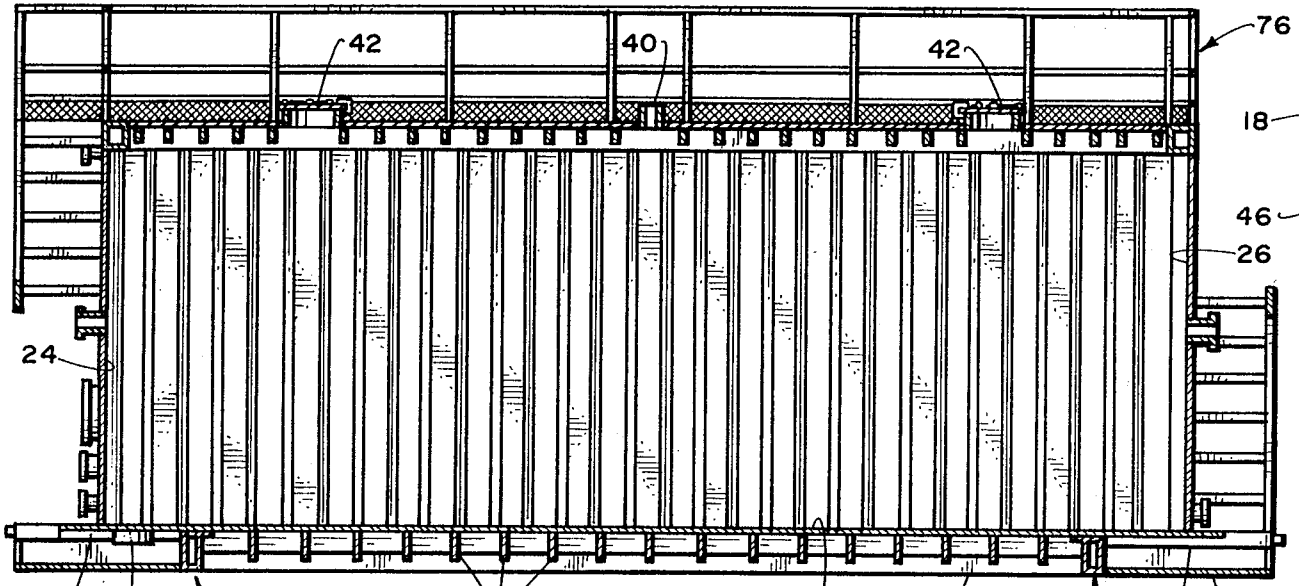
FIG. 5 is a cross-section view taken along lines 5—5 of FIG. 2.
Figure 6:
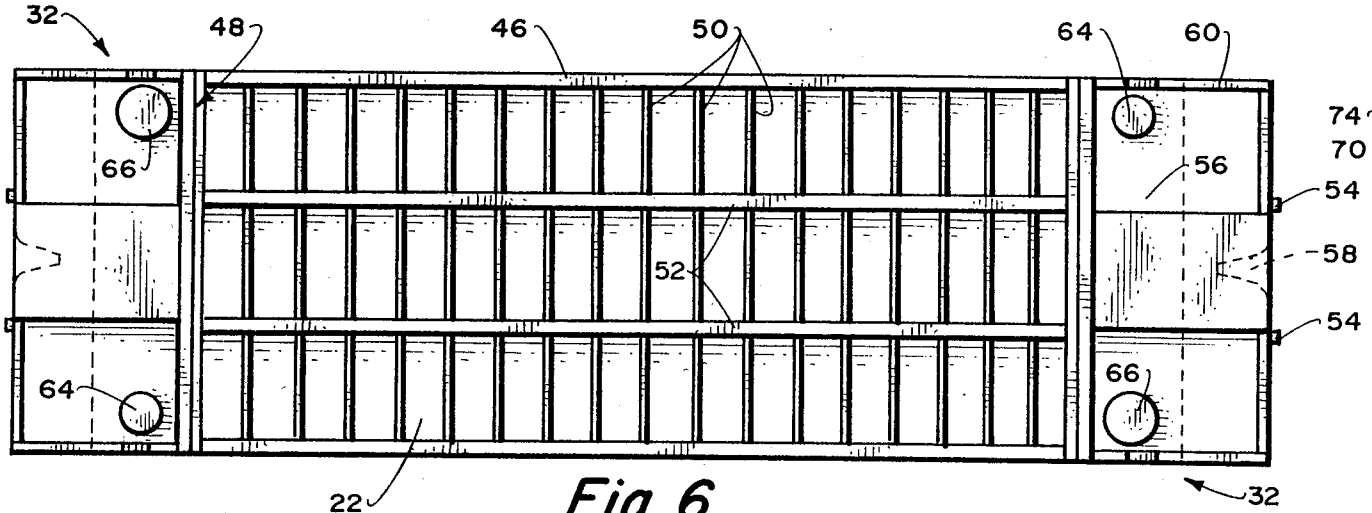
FIG. 6 is a bottom plan view of the vessel taken along lines 6—6 of FIG. 1.

The vessel side and end walls extend upwardly to a top edge (70). The top wall is connected thereto to form the aforementioned enclosed vessel. Because the walls are corrugated, it has been found beneficial to utilize a connecting member shown by hollow beam (72) in FIG. 9 as an interconnection between the top wall (20) and the corrugated side and end walls. The top edges abut against the underside of the hollow connecting beam and are secured thereto by welding or other means known in the art. Similarly, the top wall abuts against the inner side of the connecting member and is secured by welding or the like.

Extending between opposing longitudinal connecting members are top wall support members (74). The support members underlie the top wall and may be connected thereto. They are spaced apart for even support of the top wall. As shown, they are flat plates. However, angle or channel-shaped beams would work equally as well.

The top wall generally comprises a flat plate that includes the aforementioned roof hatches (42) and pipe connector means (40). A major portion of the top wall periphery is provided with a railing (76) and corresponding base grating (82). The railing comprises span members (78) which are connected to spaced-apart upright posts (80). The base of each post is hinged so that during transport, the railing may be rotated to a down position adjacent the top wall. In a similar manner, section (31) of hand railing (30) is pivoted to allow its rotation to a down position.

The vessel shown as the preferred embodiment is polyhedral in shape. However, it could have other prismatic shapes such a right triangular prism with just one end wall. Further, it is contemplated that the top wall may itself be corrugated to thereby obviate the necessity of spaced-apart roof support members (74). It is anticipated that the vessel will be an all-steel/welded construction and, as described hereinabove, comprise a self-supporting storage vessel capable of being placed upon a wheel assembly for transportation down highways and roads to predetermined work sites. Here, it may be disconnected from the wheel assembly and placed for ready access. Overall, the vessel is lighter than equivalent-sized prior art vessels. It is also easier and less costly to construct.

Because of the unique sidewall construction, heavy liquids can be contained within the vessel and the vessel can be readily cleaned for reuse with dissimilar materials. No internal cross-braces and tie rods exist whereby corrosion is minimized and service life of the tank is greatly enhanced. Further, with the unobstructed interior design, various types of corrosion inhibiting liners or coatings may be effectively applied to the interior surfaces for further maximizing its usefulness. Also, with the multiple pipe connecting means (34), various types of liquid agitating means may be installed on the interior for unobstructed operation within the vessel. This is significant in that oftentimes the vessel will be used to combine different liquids or form solid-liquid slurries where mixing and/or continuous agitation are required.

While the invention has been described with respect to a preferred embodiment, it will be apparent to those skilled in the art that other modifications or improvements may be made without departing from the scope and spirit of the invention. Accordingly, it is to be understood that the invention is not to be limited by the illustrated specific embodiment, but only by the scope of the appended claims.

We claim:

1. A portable liquid storage tank comprising:

a base supported by reinforcement means including an underlying frame having opposing longitudinal portions connected by transversely extending opposing end frame members with cross members extending between said longitudinal portions and foundation members underlying said cross members extending parallel to said longitudinal portions, said base having opposing end portions extending beyond each of said end frame members;

at least two spaced-apart quadrilateral sidewalls extending vertically from said base a distance greater than about five feet to a top edge;

a least two end walls extending vertically from said end portions outwardly from respective end frame members to a top edge a distance greater than about five feet with the opposing ends of each of said sidewalls being connected by an end wall;

each of said base opposing end portions including an extension extending outwardly from a corresponding end wall wherein at least one of said extensions having attachment means for connection with transporting means; and, a top wall connected to the top edge of each side wall and end wall to form an enclosed tank with said sidewalls being corrugated with a corrugation spacing to depth ratio of about less than 7:1.

2. The tank of claim 1 wherein said base comprises a flat plate.

3. The tank of claim 1 wherein the top edge of each sidewall and end wall includes a connector member interconnecting the top wall to said top edge.

4. The tank of claim 3 wherein said top wall is a flat plate.

5. The tank of claim 4 wherein said plate is provided with support members extending across the underside thereof.

6. The tank of claim 5 wherein the top edge of each sidewall includes a connector member with said top wall plate and support members being secured thereto.

7. The tank of claim 3 wherein the top edge of each sidewall and end wall abut against said connector member.

8. The tank of claim 7 wherein the periphery of said top wall abuts against said connector member.

9. The tank of claim 8 wherein said connector member is selected from the group consisting of a channel beam, box beam or angle beam.

10. The tank of claim 1 including an ascending means for access to said top wall.

11. The tank of claim 10 wherein said ascending means includes stairs extending from said extension to said top wall with a corresponding hand railing.

12. The tank of claim 11 wherein an upper section of said hand railing rotates to a down position.

13. The tank of claim 10 wherein said top wall includes a side rail about at least a major portion of its periphery.

14. The tank of claim 13 wherein said side rail is pivotable to a down position.

15. The tank of claim 1 wherein said top wall is a corrugated plate.

16. A portable liquid storage tank comprising a hollow polyhedral container having a base from which extend opposing sidewalls connected to opposing end walls having a height of greater than about five feet and being enclosed by a top wall, said sidewalls being corrugated and constructed of steel plate with a corrugation spacing to depth ratio of about less than 7:1, said end walls being mirror images of each other and each including a base end portion divided by a respective end wall into an interior part and an exterior part with at least one of said exterior plates having attachment means for connection to a transport vehicle, said base supported by an underlying frame that includes longitudinal portions connected by opposing end frame members positioned inwardly from said respective end walls, cross members extending between said longitudinal portions with foundation members underlying said cross members and extending parallel to said longitudinal portions, the area outward from each end frame member up to the respective end wall comprising said interior part.

17. The tank of claim 16 wherein said end walls are corrugated and constructed of steel plate with a corrugation spacing to depth ratio of about less than 7:1.

18. The tank of claim 17 wherein a connector member interconnects said top wall to said sidewalls and end walls.

19. The tank of claim 18 wherein said base and said top wall each comprise a flat steel plate.

20. The tank of claim 17 wherein said top wall is corrugated.

* * * * *